US009568225B2

(12) United States Patent
Chowdhury et al.

(10) Patent No.: US 9,568,225 B2
(45) Date of Patent: Feb. 14, 2017

(54) EVAPORATOR HAVING A HYBRID EXPANSION DEVICE FOR IMPROVED ALIQUOTING OF REFRIGERANT

(71) Applicant: MAHLE International GmbH, Stuttgart (DE)

(72) Inventors: Sourav Chowdhury, Lockport, NY (US); Prasad Shripad Kadle, Williamsville, NY (US); Carrie M. Kowsky, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 413 days.

(21) Appl. No.: 14/069,878

(22) Filed: Nov. 1, 2013

(65) Prior Publication Data

US 2015/0121950 A1 May 7, 2015

(51) Int. Cl.

| | |
|---|---|
| ***F25B 41/06*** | (2006.01) |
| ***F25B 39/02*** | (2006.01) |
| *F28F 9/02* | (2006.01) |

(52) U.S. Cl.

CPC ..... *F25B 39/02* (2013.01); *F25B 39/028* (2013.01); *F28F 9/0273* (2013.01); *F25B 2341/06* (2013.01); *F25B 2341/0662* (2013.01); *F25B 2500/18* (2013.01); *F28F 9/026* (2013.01); *F28F 9/027* (2013.01)

(58) Field of Classification Search

CPC ..... F25B 2341/0662; F25B 2341/06; F25B 39/028; F28F 9/0273; F28F 9/027; F28F 9/026

USPC ..... 165/174

See application file for complete search history.

(56) References Cited

U.S. PATENT DOCUMENTS

| | | | |
|---|---|---|---|
| 1,684,083 | A | 6/1927 | Bloom |
| 3,976,128 | A | 8/1976 | Patel et al. |
| 5,651,268 | A | 7/1997 | Aikawa et al. |
| 5,806,586 | A | 9/1998 | Osthues et al. |

(Continued)

FOREIGN PATENT DOCUMENTS

| | | | |
|---|---|---|---|
| JP | 02217764 | A | 8/1990 |
| JP | 04309766 | A | 11/1992 |

(Continued)

OTHER PUBLICATIONS

S. Lanzer, "How Thermostatic Expansion Valves (TXV) Work", Jun. 24, 2013.*

*Primary Examiner* — Orlando E Aviles Bosques
(74) *Attorney, Agent, or Firm* — Brinks Gilson & Lione

(57) ABSTRACT

An automotive evaporator heat exchanger is provided having a hybrid expansion device configured to aliquot refrigerant across the refrigerant tubes. The hybrid expansion device includes a first stage refrigerant pressure drop device and a second stage refrigerant pressure drop device. The first stage refrigerant pressure drop device is a TXV configured to receive and expand a liquid phase refrigerant into a first mixture of two phase refrigerant and the second stage refrigerant pressure drop device is a tube extending within the inlet manifold configured to expand the first mixture of two phase refrigerant into a second mixture of two phase refrigerant. The tube includes a plurality of orifices and a tube diameter large enough to prevent resistance to refrigerant flow, but, small enough to prevent the first mixture of two phase refrigerant flow from separating into liquid and vapor strata.

18 Claims, 4 Drawing Sheets

(56) References Cited

U.S. PATENT DOCUMENTS

| | | | | |
|---|---|---|---|---|
| 5,901,785 | A | 5/1999 | Chiba et al. | |
| 5,971,065 | A | 10/1999 | Bertilson et al. | |
| 6,161,616 | A | 12/2000 | Haussmann | |
| 6,729,386 | B1 * | 5/2004 | Sather | F28D 1/05316 165/110 |
| 6,814,136 | B2 | 11/2004 | Yi et al. | |
| 7,143,605 | B2 | 12/2006 | Rohrer et al. | |
| 8,171,987 | B2 | 5/2012 | Jiang et al. | |
| 2003/0116310 | A1 | 6/2003 | Wittmann et al. | |
| 2004/0026072 | A1 | 2/2004 | Yi et al. | |
| 2008/0093051 | A1 * | 4/2008 | Rios | F28F 9/0273 165/176 |
| 2009/0073483 | A1 | 3/2009 | Oomori | |
| 2009/0173482 | A1 | 7/2009 | Beamer et al. | |
| 2009/0229805 | A1 | 9/2009 | Beamer et al. | |
| 2011/0000255 | A1 * | 1/2011 | Taras | F28F 9/0273 62/498 |
| 2011/0290465 | A1 * | 12/2011 | Joshi | F28F 9/0273 165/175 |
| 2012/0061064 | A1 * | 3/2012 | Stromer | F28D 9/005 165/177 |

FOREIGN PATENT DOCUMENTS

| | | | |
|---|---|---|---|
| JP | 2002062082 | A | 2/2002 |
| WO | 94/14021 | | 6/1994 |

* cited by examiner

EVAPORATOR HAVING A HYBRID EXPANSION DEVICE FOR IMPROVED ALIQUOTING OF REFRIGERANT

TECHNICAL FIELD

The present disclosure relates to an automotive evaporator; more particularly to a refrigerant expansion device for aliquoting a refrigerant through the refrigerant tubes of the automotive evaporator.

BACKGROUND OF INVENTION

An air-conditioning system for a motor vehicle typically includes a refrigerant loop having an evaporator located within a heating, ventilation, and air-conditioning (HVAC) module for supplying conditioned air to the passenger compartment, an expansion device located upstream of the evaporator, a condenser located upstream of the expansion device in front of the engine compartment, and a compressor located within the engine compartment upstream of the condenser. The above mentioned components are hydraulically connected in series within the closed refrigerant loop.

The compressor compresses and circulates a refrigerant through the closed refrigerant loop. Starting from the inlet of the evaporator, a low pressure two phase refrigerant having mixture of liquid and vapor enters the evaporator and flows through the refrigerant tubes of the evaporator where it expands into a low pressure vapor refrigerant by absorbing heat from an incoming air stream. The low pressure vapor refrigerant then exits the outlet of the evaporator and enters the compressor where it is compressed into a high pressure high temperature vapor. The high pressure vapor refrigerant then flows through the condenser where it condenses into a high pressure liquid refrigerant by releasing the heat to the ambient air outside the motor vehicle. The condensed high pressure liquid refrigerant is returned to the evaporator through the expansion device, which expands the high pressure liquid refrigerant to a low pressure mixture of liquid-vapor refrigerant to repeat the cycle.

A conventional evaporator includes an inlet manifold, an outlet manifold, and a plurality of refrigerant tubes hydraulically connecting the manifolds. Additionally, there may be one or more intermediate manifolds, such as a return manifold, between the inlet and outlet manifold. The flow rate of refrigerant through the evaporator, typically in the range of 25 to 300 kg/hr for an R-134a refrigerant, depends predominantly on the rotational speed of the engine of the motor vehicle measured in revolutions per minute (rpm). This is a result of the compressor being driven directly by the engine via an accessory belt; hence, the compressor speed changes with the engine rpm.

It is desirable to be able to aliquot, break into equal parts, the two-phase refrigerant to the refrigerant tubes of the evaporator to provide uniform cooling of the airstream. If the two-phase refrigerant enters the inlet manifold at a relatively high velocity, the liquid phase of the refrigerant is carried by momentum of the flow further away from the entrance of the inlet manifold to the distal end of the inlet manifold. Hence, the refrigerant tubes closest to the inlet manifold entrance receive predominantly the vapor phase and the refrigerant tubes near the distal end of the inlet manifold receive predominantly the liquid phase. On the other hand, if the two-phase refrigerant enters the inlet manifold at a relatively low velocity, the refrigerant tubes closest to the inlet manifold entrance receives predominantly the liquid phase and the refrigerant tubes near the distal end of the inlet manifold receives predominantly the vapor phase. This is especially true as it relates to the mass fraction of refrigerant compared to the volume fraction. In either case, this results in the misaliquoting of the refrigerant flowing through the refrigerant tube causing degradation in the heat transfer efficiency of the evaporator.

An undesirable effect of misaliquoting of the liquid refrigerant is the skewing of the temperature map of the air coming off the evaporator. At a high refrigerant flow velocity, the temperature of the air stream across the refrigerant tubes at the distal end of the inlet manifold are lower compared to that of air stream across the tubes near the inlet. At low flow velocities this is reversed. The skewing and changing pattern of temperature of outlet air is undesirable. First, it is indicative of inefficient heat transfer process. Second, it prevents appropriately locating a temperature sensor on downstream face of the evaporator. This temperature sensor is intended to measure the lowest temperature of the air and it controls the fixed displacement compressor by switching it off when a set minimum temperature is reached, thereby protecting it from being damaged. The resulting non-uniform temperature pattern, which changes subject to the refrigerant flow velocity, causes difficulty in maintaining an even balance of vent temperatures out of the HVAC module. In certain instances, this imbalance in left and right vent temperatures causes perceptible discomfort to the vehicle occupants.

There is a need for a device which regulates the aliquoting of refrigerant flow in the inlet manifold to the refrigerant tubes and maintains an even pattern of temperature of the outlet air, despite changes in refrigerant flow velocity caused by the inherently varying engine speeds.

SUMMARY OF THE INVENTION

Figure 1:
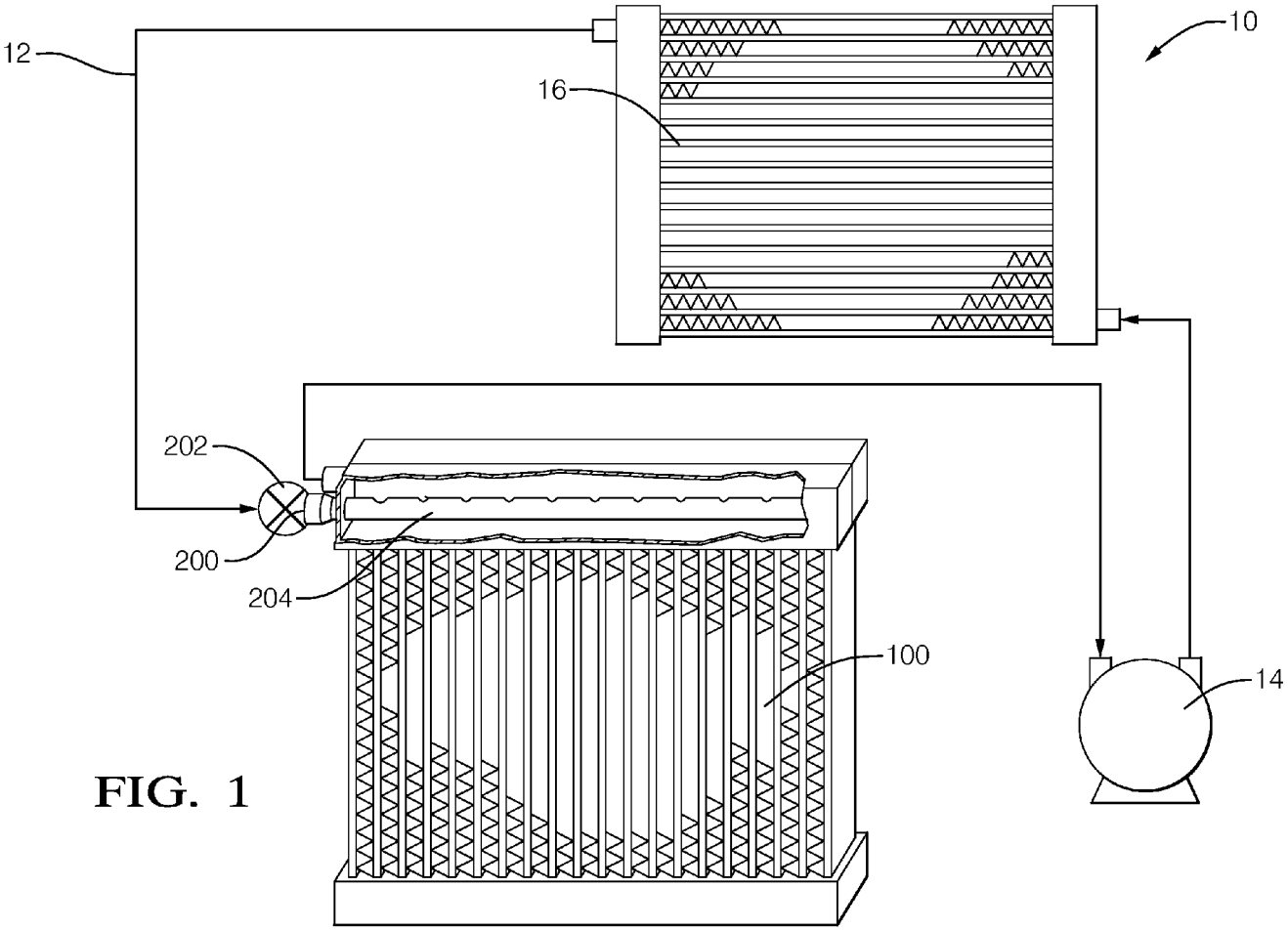
FIG. 1 shows a schematic of an air conditioning system having a hybrid expansion device.

Briefly, one aspect of the invention is an automotive evaporator heat exchanger having a hybrid expansion device (HED). The evaporator includes an elongated inlet manifold defining an interior chamber extending along a manifold axis A and a plurality of refrigerant tubes extending into the interior chamber. The HED includes a first stage refrigerant pressure drop device configured to receive and expand a liquid phase refrigerant into a first mixture of two phase refrigerant and a second stage refrigerant pressure drop device disposed in the inlet manifold and configured to receive and expand the first mixture of two phase refrigerant into a second mixture of two phase refrigerant and aliquot the second mixture of two phase refrigerant to the open ends of the plurality of refrigerant tubes.

The first stage refrigerant pressure drop device is a TXV configured to receive and expand a liquid phase refrigerant into a first mixture of two phase refrigerant having about 75-85% by mass liquid phase. The second stage refrigerant pressure drop device is a tube having a plurality of orifices configured to expand the first mixture of two phase refrigerant into a second mixture of two phase refrigerant having about 65-75% by mass liquid phase. The preferred range of the internal diameter of the EOT is such that it should be large enough to prevent resistance to refrigerant flow where less than the allocated amount of the refrigerant is able to flow to the distal end 216 of the EOT, but, small enough to prevent the incoming first mixture of two phase refrigerant flow from separating into liquid and vapor strata.

The evaporator having an HED achieves 17% energy reduction as compared to an evaporator having only a conventional orifice tube. The evaporator having an HED also provides a noise-free, uniform temperature distribution, and quick transient refrigerant flows corresponding to varying engine rpm. Another benefit of the evaporator having an HED, is that it eliminates the need for an Accumulator/Dehydrator (A/D), which adds pressure drop and reduces the performance of the air-conditioning system. Every 1 psi of pressure drop in the suction line to the compressor results in an increase in air outlet temperature by almost 0.75° F. The A/D traditionally adds about 3 psi pressure drop at high flows.

In the drawings as hereinafter described, a preferred embodiment is depicted; however, various other modifications and alternative designs and construction can be made thereto without departing from the spirit and scope of the invention.

DETAILED DESCRIPTION OF INVENTION

Shown in FIG. 1 is schematic illustration of an air conditioning system 10 having a closed refrigerant loop 12 hydraulically connecting a compressor 14, a condenser 16, and an evaporator 100 in series. The evaporator 100 includes a hybrid expansion device (HED) 200 configured to provide uniform refrigerant aliquoting through the evaporator 100 for all operating refrigerant flow velocities caused by variations in the compressor 14 speed. The HED 200 includes a first stage refrigerant pressure drop device 202, such as a Thermostatic Expansion Valve (TXV) 202, and a second stage refrigerant pressure drop device 204, such as an enhanced orifice tube (EOT) 204.

Figure 2:
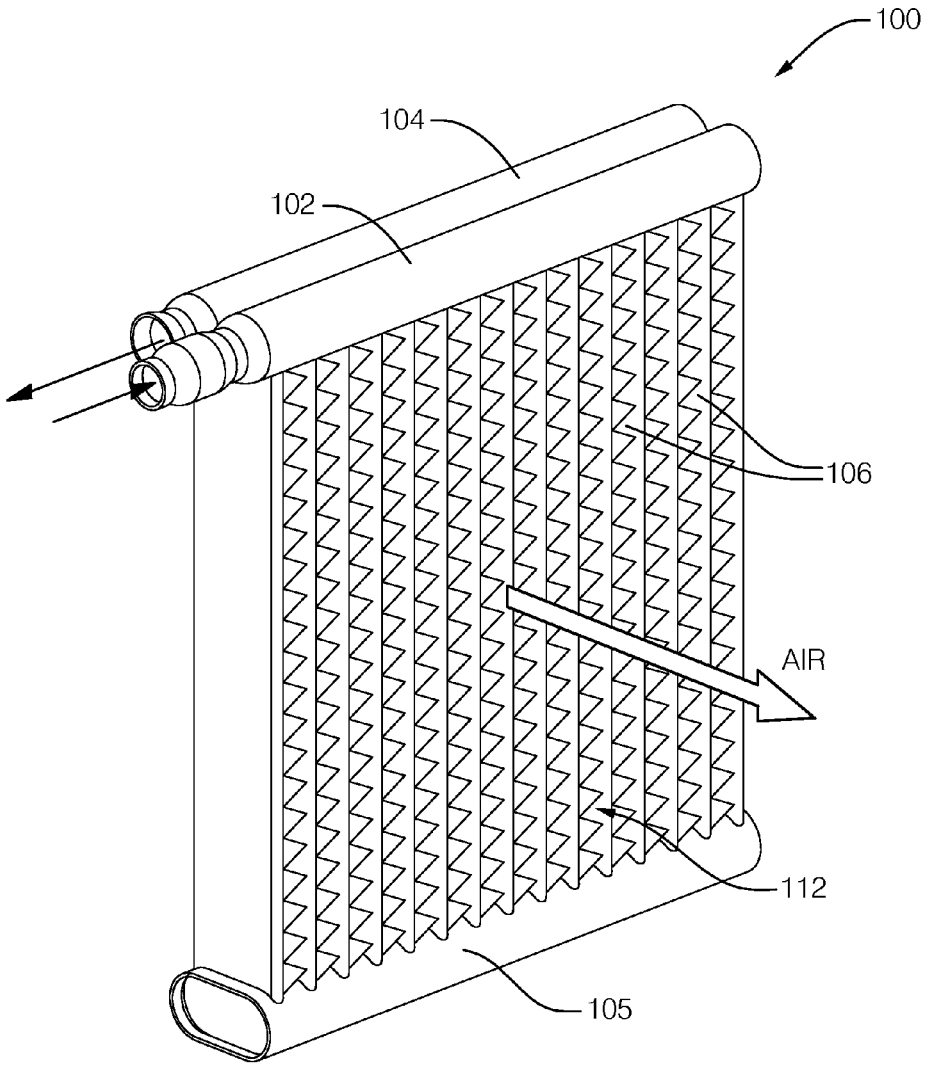
FIG. 2 shows an exemplary evaporator having a hybrid expansion device.
Figure 3:
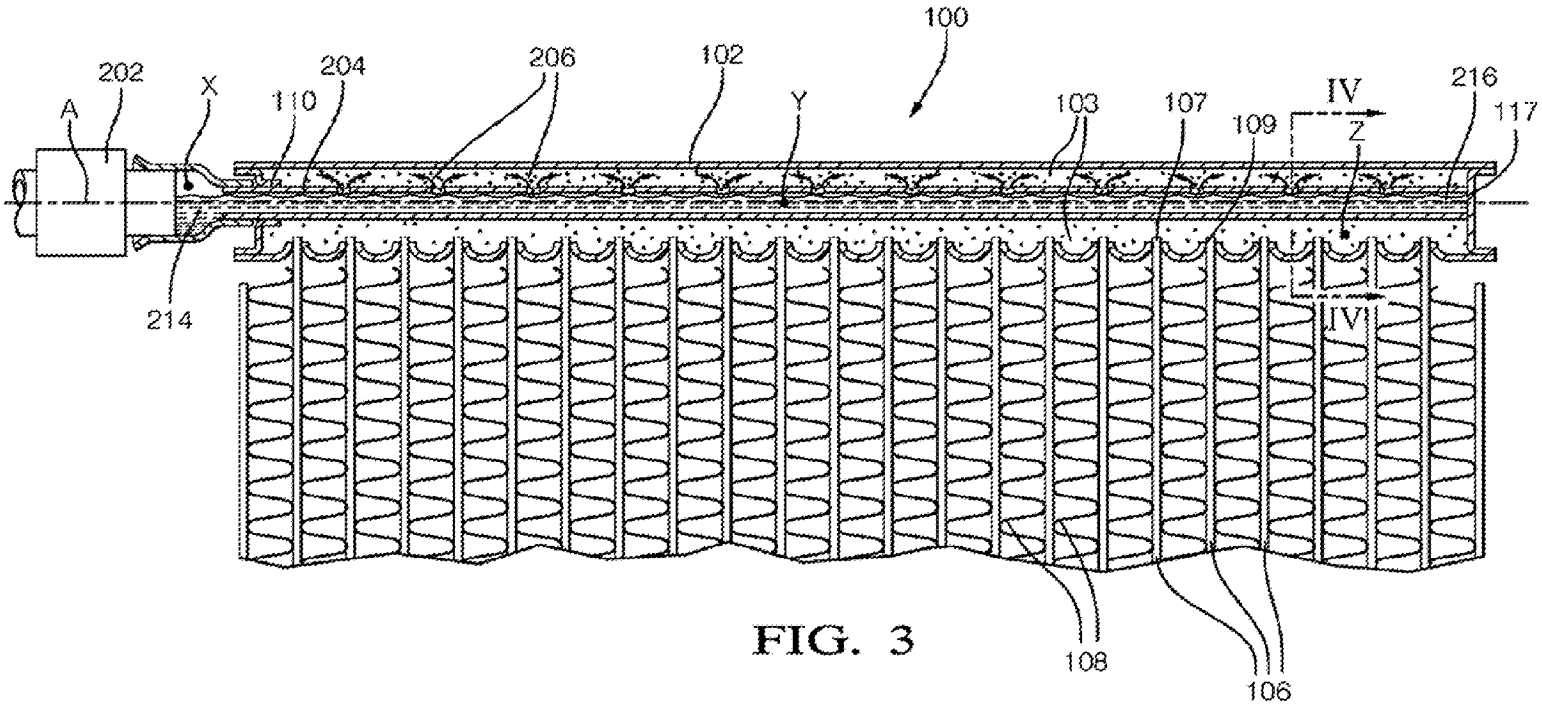
FIG. 3 shows a cross-sectional view of the inlet manifold of the evaporator shown in FIG. 2.

Shown in FIGS. 2 and 3 is the exemplary evaporator 100 having a HED 200 of the current invention. The evaporator 100 includes an inlet manifold 102, an outlet manifold 104, and plurality of refrigerant tubes 106 hydraulically connecting the manifolds 102, 104 for refrigerant flow from the inlet manifold 102 to the outlet manifold 104. Each of the refrigerant tubes 106 defines a U-shaped path for refrigerant flow therebetween, thereby enabling the inlet manifold 102 and outlet manifold 104 to be placed in a side-by-side parallel arrangement. The evaporator 100 may also include a return manifold 105 in hydraulic connection with and spaced from inlet and outlet manifolds 102, 104. The inlet open ends 107 of the refrigerant tubes 106 are inserted through tube slots 109 positioned along the inlet manifold 102 for refrigerant flow from the inlet manifold 102 to the refrigerant tubes 106. The inlet manifold 102 and outlet manifold 104 are shown above the refrigerant tubes 106 with respect to the direction of gravity. A plurality of fins 108 is disposed between the refrigerant tubes 106 to facilitate heat exchange between the refrigerant and a stream of ambient air. The refrigerant tubes 106 and fins 108 are formed of a heat conductive material, preferably an aluminum alloy, assembled onto the manifolds 102, 104 and brazed into an evaporator heat exchanger assembly.

Shown in FIG. 3 is a cross-sectional view of the inlet manifold 102 of the evaporator 100 extending along a manifold axis A. The inlet manifold 102 includes an inlet port 110 for receiving the second stage refrigerant pressure drop device 204, which is configured to cooperate with the upstream first stage refrigerant pressure drop device 202 to improve refrigerant aliquoting across refrigerant tubes 106 of the evaporator 100. The first stage refrigerant pressure drop device 202 expands a liquid refrigerant from the condenser into a first mixture of two phase refrigerant and the second stage refrigerant pressure drop device 204 expands the first mixture into a second mixture of two phase refrigerant.

The second stage refrigerant pressure drop device 204 may be that of an EOT 204 disposed within the interior chamber 103 defined by the inlet manifold 102, extending substantially the length of the interior chamber 103 and substantially parallel with the manifold axis A. The EOT 204 includes an inlet end connector 214, a blind distal end 216 opposite that of the inlet end connector 214, and a plurality of orifices 206 therebetween. The inlet end connector 214 is in direct hydraulic connection with the upstream first stage refrigerant pressure drop device 202. The inlet end connector 214 having a first end outside the inlet manifold 102, receiving an outlet end of the first stage refrigerant pressure drop device 202, and having a second end, inside the inlet manifold 102, receiving an inlet end of the second stage refrigerant pressure drop device 204. The blind distal end 216 is typically mounted by capturing it in the end cap 117 of the inlet manifold 102. The plurality of orifices 206 may be arranged in a linear array parallel to the manifold axis A and oriented away from the inlet open ends 107 of the refrigerant tubes 106, preferably 180 degrees from the inlet open ends 107 and in the opposite direction of gravity. As shown in FIG. 2, the in-vehicle position is such that the manifolds 102, 104 are at the top, the return manifold 105 is at the bottom, and the evaporator face 112 is substantially perpendicular to the ground. In a case where the evaporator face 112 is tilted towards the ground, up to 60° from the vertical, it is still preferable that the orifices 206 of the EOT 204 are substantially opposite to the gravity direction.

The first stage refrigerant pressure drop device 202 shown in FIG. 1 may be that of a low pressure drop TXV (LP-TXV) 202, configured to operate at a pressure drop lower than that of the pressure drop of a conventional TXV for a conditioning system without an orifice tube. The HED 200 provides a two stage total pressure drop, in which the total pressure drop is apportioned between the LP-TXV 202 and the EOT 204 and is equivalent to the pressure drop of a conventional TXV. It was surprisingly found that a controlled two stage pressure drop provided by the LP-TXV and EOT working in unison, resulted in the improved aliquoting of refrigerant through the refrigerant tubes 106 of the evaporator 100.

Figure 5:
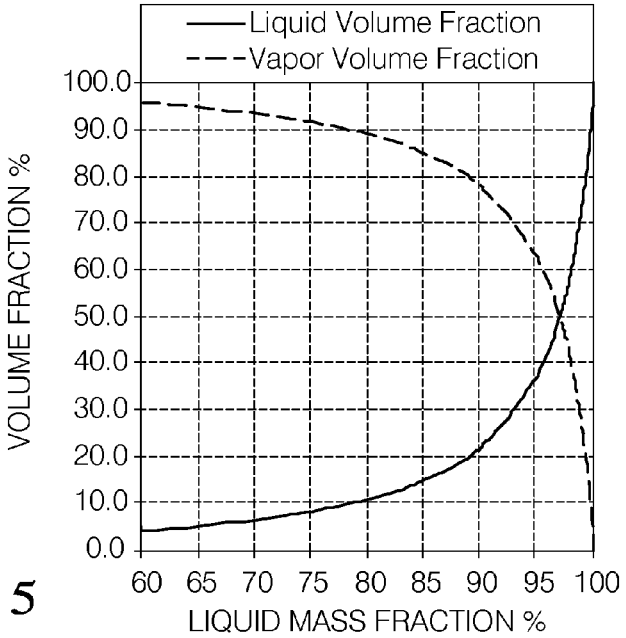
FIG. 5 is a graph showing the relationship between the liquid volume fraction and the vapor volume fraction of a refrigerant.

The LP-TXV 202 is configured to provide a first mixture of two phase refrigerant to the EOT 204. The EOT 204 serves as a retention and expansion device where it retains and accumulates the first mixture of two phase refrigerant until the liquid part of the incoming mixture substantially fills the interior volume of the EOT 204 before being discharged through the orifices 206 as a second mixture of two phase refrigerant, thereby aliquoting the refrigerant across the refrigerant tubes 106. Referring to FIG. 3, about point X of the HED immediately downstream of the LP-TXV 202, the first mixture of two phase refrigerant has a liquid mass fraction of 75% and a corresponding liquid volume fraction of only 8.9%. Here, only 8.9% of the volume of the EOT 204 is occupied by liquid and the remaining 90.1% volume is occupied by vapor. Shown in Table 1 below and in FIG. 5 is a chart and graph, respectively, showing the liquid mass fraction of a refrigerant and the corresponding liquid volume and vapor volume fractions for refrigerant R134a at a typical evaporator inlet pressure and temperature.

TABLE 1

| Liquid Mass Fraction (kg/kg) % | Liquid Volume Fraction (m^3/m^3) % | Vapor Volume Fraction (m^3/m^3) % |
|---|---|---|
| 60 | 4.7 | 95.3 |
| 65 | 5.7 | 94.3 |
| 70 | 7.1 | 92.9 |
| 75 | 8.9 | 91.1 |
| 80 | 11.5 | 88.5 |
| 85 | 15.6 | 84.4 |
| 90 | 22.6 | 77.4 |
| 95 | 38.2 | 61.8 |
| 97 | 51.3 | 48.7 |
| 98 | 61.4 | 38.6 |
| 99 | 76.3 | 23.7 |
| 100 | 100.0 | 0.0 |

Still referring to FIG. 3, about point Y, if the first mixture of two phase refrigerant is allowed to stay at the same state inside the EOT 204, again about 90% of volume of the EOT 204 will be occupied with vapor. In such a case, the shortcoming is that some of the orifices may have only vapor flowing out of them causing hiss noise which is highly undesirable. In reality, however, because of sitting liquid inside the EOT 204, effectively the volume fraction of the liquid is higher inside EOT than it is at the inlet. An estimate for effective liquid volume fraction inside EOT is about 50%, which correspond to a liquid mass fraction of 97%. This high proportion of liquid (by mass and also by volume) ensures that liquid particles eject out of each of the orifices, thereby disrupting the sound pressure waves generated in the vapor; therefore, this prevents the hiss noise generation. Also this high proportion of liquid ensures aliquoting process will be achieved. So the idea here is to have an internal diameter of the EOT 204 such that that after the first stage mixture comes in, it is further mixed with the sitting liquid, rendering the inside-EOT liquid mass fraction to significantly increase. However, the EOT diameter should not be so large as to cause the separation of vapor from liquid; in other words, the mixture should stay as a mixture even after combining with the sitting liquid inside the EOT.

Still referring to FIG. 3, at about point Z, once the refrigerant has exited the orifices 206, it is said to be the second mixture of two phase refrigerant. At this state, the liquid mass fraction, approximately 65%, is not of much concern as aliquoting has already occurred and each refrigerant tube is being fed with approximately the same amounts of liquid and vapor.

Figure 4:
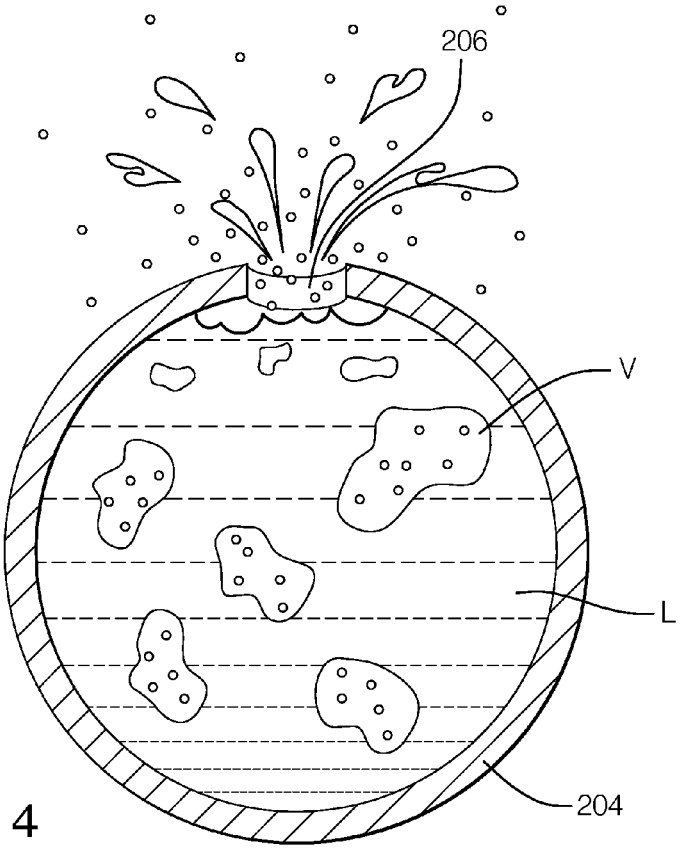
FIG. 4 shows a cross-sectional view of the enhanced orifice tube of FIG. 3.

As shown in FIG. 4, a substantially high liquid volume fraction refrigerant is desirable in the EOT 204 because a liquid refrigerant is easier to aliquot amongst the refrigerant tubes 106 than refrigerant with a substantially high vapor volume fraction. It is preferable that the LP-TXV be configured to provide a first stage pressure drop such that the first mixture of two phase refrigerant exiting the LP-TXV 202 into the EOT 204 is approximately 75-85% by mass in the liquid phase (L) having vapor bubbles (V) dispersed in the liquid phase (L). It is preferable that the EOT 204 be configured by varying the diameter, orifice size, and orifice spacing to provide a second stage pressure drop such that the second mixture of two phase refrigerant flowing out of the orifices 206 the EOT 204 into the manifold 100 is approximately 65-75% by mass in the liquid phase. It is also preferred that the diameter, orifice size, and orifice spacing of the EOT 204 be sized to retain a liquid phase of refrigerant that occupies at least 99% of the cross-sectional area of the EOT 204.

The length and internal diameter of the EOT 204 determines the resistance to axial flow of refrigerant and has a pressure drop associated with it. Similarly, the design of the orifice array, defined by the number and diameter of orifices, also determines a pressure drop associated with it. The pressure drop of the flow from the inlet end connector 214 to the distal end 216 inside the EOT 204 in the axial direction should be approximately 5% to 10% of the total pressure drop across EOT 204 for effective control at all flow velocities.

For the EOT 204, each orifice 206 and a segment of the EOT between it and the upstream orifice functions as a short orifice tube. Thus the EOT 204 can be considered as a series of multiple short orifice tubes connected end to end. This is how the EOT 204 differs from a conventional monolithic orifice tube which handles the total flow through it. By apportioning the total refrigerant flow equally to these short orifice tubes, uniform refrigerant aliquoting is achieved.

The preferred range of the internal diameter of the EOT is such that it should be large enough to prevent resistance to refrigerant flow where less than the allocated amount of the refrigerant is able to flow to the distal end 216 of the EOT, but, small enough to prevent the incoming first mixture of two phase refrigerant flow from separating into liquid and vapor strata.

The preferred orientation of the array of orifices is such that the orifices are oriented upward, away from the direction of gravity. It is preferable to orient the array of orifices 206 substantially upward and not sideways or downward with respect to the direction of gravity. If the orifices 206 are oriented substantially downward, the liquid phase refrigerant may drain out of the orifices 206 under the force of gravity soon after entering the EOT 204 and the orifices 206 nearest the inlet port 110 will be disproportionately favored by the liquid refrigerant leaving only a trickle of the liquid flowing to the last few orifices farthest from the inlet port 110. This is especially true at low refrigerant flow conditions.

The total pressure drop in the EOT 204 results in the lowering of the inlet quality of refrigerant, meaning the mass proportion of the liquid to vapor is increased, thereby, helping the distribution inside the EOT. Without the EOT 204, the mass proportion of the liquid to vapor phase entering the evaporator 100 will be lower, giving rise to poor distribution of refrigerant across the refrigerant tubes 106. Besides being an aliquoting mechanism, the EOT 204 is thus a throttling mechanism, but the throttling is happening in multiple stages spread out across the length of the EOT above the refrigerant tubes 106. Thus the refrigerant tubes 106 are receiving aliquoted flow compared to the situation when EOT is absent and the TXV is the sole throttling device present upstream of the inlet of the evaporator.

A benefit of the evaporator 100 having an HED 200 is that the evaporator having an HED achieves 17% energy reduction as compared to an evaporator having only a conventional orifice tube. Compared to the evaporator having only a TXV, the evaporator 100 having an HED 200 provides a noise-free, uniform temperature distribution, and is responsive to sudden transient refrigerant flows corresponding to varying engine rpm. Another benefit of evaporator 100 having an HED 200, is that it eliminates the need for an Accumulator/Dehydrator (A/D) in the downstream side of the evaporator, which is needed for conventional orifice tube systems and which adds pressure drop and reduces the performance of the air-conditioning system. Every 1 psi of pressure drop in the downstream side of the evaporator results in an increase in air outlet temperature by almost 0.75° F. The A/D traditionally adds about 3 psi pressure drop at high flows.

While this invention has been described in terms of the preferred embodiments thereof, it is not intended to be so limited, but rather only to the extent set forth in the claims that follow.

Having described the invention, it is claimed:

1. An automotive evaporator heat exchanger comprising:

an inlet manifold defining an interior chamber extending along a horizontal manifold axis;

a plurality of refrigerant tubes, each having an open end extending into the interior chamber from an underside of the inlet manifold, a first stage refrigerant pressure drop device configured to receive and expand a liquid phase refrigerant into a first mixture of two phase refrigerant;

a second stage refrigerant pressure drop device disposed in the interior chamber and configured to receive and expand the first mixture of two phase refrigerant into a second mixture of two phase refrigerant and aliquot the second mixture of two phase refrigerant to the open ends of the plurality of refrigerant tubes, wherein the second stage refrigerant pressure drop device is a pressure-drop tube having a plurality of orifices configured to expand the first mixture of two phase refrigerant into the second mixture of two phase refrigerant; and an inlet end connector having a first end outside the inlet manifold, receiving an outlet end of the first stage refrigerant pressure drop device, and having a second end inside the inlet manifold, receiving an inlet end of the second stage refrigerant pressure drop device;

wherein the orifices of the second stage refrigerant pressure drop device are oriented opposite to the direction of gravity and away from the refrigerant tubes.

2. The automotive evaporator heat exchanger of claim 1, wherein the inlet manifold includes the inlet port and a plurality of refrigerant tube slots;

wherein each open end of the plurality of refrigerant tubes extends through a corresponding one of the plurality of tube slots such that the open ends are in hydraulic communication with the interior chamber;

further comprising a hybrid expansion device including the first stage refrigerant pressure drop device and the second stage refrigerant pressure drop device.

3. The automotive evaporator heat exchanger of claim 2, wherein the first stage refrigerant pressure drop device is located adjacent to the inlet port.

4. The automotive evaporator heat exchanger of claim 3, wherein the second stage refrigerant pressure drop device is in hydraulic connection downstream of the first stage refrigerant pressure drop device and disposed within the interior chamber.

5. The automotive evaporator heat exchanger of claim 4, wherein the first stage refrigerant pressure drop device is a thermal expansion valve configured to expand the liquid phase refrigerant into the first mixture of two phase refrigerant having about 75-85% by mass liquid phase.

6. The automotive evaporator heat exchanger of claim 5, wherein the pressure-drop tube disposed within the interior chamber of the inlet manifold includes a blind distal end opposite that of the inlet end, and the plurality of orifices between the blind distal end and the inlet end;

wherein the pressure-drop tube is configured to retain and accumulate a portion of the liquid phase of the first mixture of two phase refrigerant and expand the first mixture of two phase refrigerant into the second mixture of two phase refrigerant having about 65-75% by mass liquid phase.

7. The automotive evaporator heat exchanger of claim 6, wherein the plurality of orifices are arranged in a linear array parallel to the inlet manifold.

8. The automotive evaporator heat exchanger of claim 7, wherein the pressure-drop tube is configured to retain and accumulate the first mixture of two phase refrigerant until a liquid phase of the first mixture of the two phase refrigerant fills the interior volume of the pressure-drop tube before being discharged through the orifices as a second mixture of two phase refrigerant, thereby aliquoting the two-phase refrigerant across the refrigerant tubes.

9. The automotive evaporator heat exchanger of claim 7, wherein the pressure-drop tube includes a tube diameter defining a cross-sectional area, wherein the pressure-drop tube is sized such that, during operation of the evaporator heat exchanger, the liquid phase of accumulated refrigerant occupies at least 99% of the cross-sectional area beneath the orifices.

10. The automotive evaporator heat exchanger of claim 9, wherein the pressure-drop tube diameter is small enough to prevent the incoming first mixture of two phase refrigerant flow from separating into a liquid and vapor strata.

11. The automotive evaporator heat exchanger of claim 10, wherein the pressure-drop tube is configured such that the pressure drop of the flow from the inlet end to the distal end in the axial direction is below 10% of the total pressure drop across the pressure-drop tube at all flow velocities of the two-phase refrigerant.

12. The automotive evaporator heat exchanger of claim 1, wherein the first stage refrigerant pressure drop device is a thermostatic expansion valve configured to expand the liquid phase refrigerant into the first mixture of the two phase refrigerant having about 75-85% by mass liquid phase.

13. The automotive evaporator heat exchanger of claim 12, wherein the second stage refrigerant pressure drop device is configured to expand the first mixture of two phase refrigerant into the second mixture of two phase refrigerant having about 65-75% by mass liquid phase.

14. The automotive evaporator heat exchanger of claim 13, wherein the pressure-drop tube diameter is small enough to prevent the incoming first mixture of two phase refrigerant flow from separating into liquid and vapor strata.

15. The automotive evaporator heat exchanger of claim 14, wherein the tube diameter is further small enough such that the second mixture of two phase refrigerant occupies at least 99% of the cross-sectional area of the pressure-drop tube.

16. The automotive evaporator heat exchanger of claim 1, wherein the pressure-drop tube is configured to retain and accumulate the first mixture of two phase refrigerant until a liquid phase of the first mixture of two phase refrigerant fills the interior volume of the pressure-drop tube before being discharged through the orifices as a second mixture of two phase refrigerant, thereby aliquoting the refrigerant across the refrigerant tubes.

17. The automotive evaporator heat exchanger of claim 16, wherein the plurality of orifices are arranged in a linear array parallel to the inlet manifold.

18. The automotive evaporator heat exchanger of claim 16, wherein the pressure-drop tube includes a tube diameter defining a cross-sectional area, wherein the pressure-drop tube is sized such that, during operation of the evaporator heat exchanger, the liquid phase of the accumulated first mixture of two phase refrigerant occupies at least 99% of the cross-sectional area beneath the orifices of the pressure-drop.

* * * * *